United States Patent [19]

Ito

[11] Patent Number: 5,028,520

[45] Date of Patent: Jul. 2, 1991

[54] SILVER HALIDE PHOTOGRAPHIC MATERIAL FOR X-RAY USE

[75] Inventor: Tadashi Ito, Kanagawa, Japan

[73] Assignee: Fuji Photo Film Co., Ltd., Kanagawa, Japan

[21] Appl. No.: 357,140

[22] Filed: May 26, 1989

[30] Foreign Application Priority Data

May 30, 1988 [JP] Japan ..... 63-132411

[51] Int. Cl.[5] ..... G03C 1/35; G03C 1/6

[52] U.S. Cl. ..... 430/567; 430/631; 430/950; 430/966

[58] Field of Search ..... 430/966, 950, 567, 631

[56] References Cited

U.S. PATENT DOCUMENTS 3,929,486 12/1975 Habu et al. ..... 430/631
4,425,426 1/1984 Abbott et al. ..... 430/502
4,647,528 3/1987 Yamada et al. ..... 430/567

FOREIGN PATENT DOCUMENTS 269137 11/1987 Japan .

*Primary Examiner*—Charles L. Bowers, Jr.
*Assistant Examiner*—Mark R. Buscher
*Attorney, Agent, or Firm*—Sughrue, Mion, Zinn Macpeak & Seas

[57] ABSTRACT

A silver halide photographic material for X-ray use comprising a support having provided thereon at least one hydrophilic colloid layer, at least one of which is a silver halide emulsion layer, wherein the silver halide emulsion layer contains tabular silver halide grains having an aspect ratio of 3 or more, and at least one of the silver halide emulsion layers or other hydrophilic colloid layers of the photographic material contains a polyhydroxy-substituted benzene compound in an amount of from $3\times10^{-2}$ mol to less than $5\times10^{-1}$ mol per mol of silver.

10 Claims, No Drawings

SILVER HALIDE PHOTOGRAPHIC MATERIAL FOR X-RAY USE

FIELD OF THE INVENTION

This invention concerns a silver halide photosensitive material for X-ray use, and in particular concerns reduction of the reflection index of the blackened silver image portion after processing this making the picture easier to interpret, wherein the photosensitive material contains tabular silver halide grains having an aspect ratio of 3 or more.

BACKGROUND OF THE INVENTION

In general, the photographic material used for photographing human internal organs, etc., by X-rays, i.e., photosensitive material for X-ray use, consists either of indirect photography X-ray film wherein visible images on a fluorescent plate produced by X-rays are photographed with an optical lens, or direct photography X-ray film where no optical lens is used and the fluorescence produced by irradiation with the X-rays is directly recorded on film (referred to below as "X-ray film for direct use").

X-ray film usually has at least one layer of photosensitive silver halide emulsion on each side of a transparent support.

In general, when forming an image on X-ray film for direct use by X-ray irradiation, the film is placed between fluorescent screens and irradiated with X-rays. The X-ray energy absorbed by the fluorescent screens on both sides of the film emits a blue-green fluorescence, to which the film is photosensitive. As a result, an X-ray image is formed.

An image may be formed by exposure of the photosensitive material to the X-ray energy. However, the film is overwhelmingly more sensitive to the blue-green fluorescence.

Thus when forming images directly on X-ray film, X-ray energy can be efficiently used by the concurrent use of fluorescent screens. Thus, the radiation exposure dose is reduced.

On the other hand, when using fluorescent screens, the sharpness of the image deteriorates.

This disadvantage is present because, when X-ray film for direct use with a silver halide emulsion on both sides of a support is inserted between fluorescent screens and irradiated with X-rays, not only does the light emitted from one of the fluorescent screens form a latent image in the adjacent silver halide emulsion layer (becoming a developed blackened silver image), but a considerable amount of light passes through the support and also forms an indistinct latent image in the silver halide emulsion layer on the other side of the support. This phenomenon is known as "cross-over".

The degree of cross-over greatly affects the final image sharpness.

The image formed by cross-over is indistinct because the light is dispersed in the opposite silver halide emulsion layer and in the support. Additionally, the light is dispersed and refracted on the periphery of the opposite emulsion layer and support forming light reflections.

Much research has been done in the past with respect to the loss of image clarity due to cross-over and regarding the reduced sensitivity when the cross-over is eliminated as described in GB Patent No. 1,422,534, U.S. Pat. No. 3,989,527, GB Patent 504,283 and JP-A-54-31737 and JP-A-49-69324, etc. (the term "JP-A" as used herein means an "unexamined published Japanese patent application").

All of the above methods have been unsatisfactory in practical use: some are effective in cutting out cross-over but reduce the sensitivity, other methods use silver which does not contribute to sensitivity, this being undesirable in times when silver is being economized, or still other methods use fluorescent substances which have a severe effect on photographic performance.

A further method of eliminating cross-over, as described by JP-A-58-127921 and U.S. Pat. Nos. 4,416,986 and 4,413,053 employs the silver halide grains themselves to absorb the cross over light by enlarging the projected surface area of the photosensitive silver halide grains themselves.

In other words, a method has been disclosed for eliminating cross-over without increasing the amount of silver used (in proportion to the volume of silver halide grains) using tabular silver halide grains whose grain diameter is not less than 5 times the grain thickness. By this method, cross-over is eliminated without marked reduction of sensitivity and the sharpness is improved.

Now, with X-ray film for direct use, the usual procedure is that after development, the images on the X-ray film for direct use are read from the top of a light table, etc. through a light source.

However, when the surface of the blackened silver image is smooth and the image is observed from the top of a light table, etc., light emitted from a source behind the observer, e.g. a light in the room, is reflected from the blackened silver image. The observer's figure is thus reflected from the film as in a mirror, making it difficult to interpret the actual image. This problem is particularly prevalent in the material of JP-A-58-127921 and in other direct X-ray films, in that the blackened silver image portion of the film for direct X-ray using tabular silver halide grains has a high reflection index, making it difficult to interpret the image.

Examples of methods for reducing the surface reflection index are disclosed in JP-A-57-104133, JP-A-57-20731, and JP-A-58-163936 etc. Although the reflection index of the blackened silver image portion is thereby reduced, there are the disadvantages of a low image sharpness results and less light passes through non-image areas so as to increase the haze. Hence, it has been very difficult to simultaneously satisfy the requirements of sharpness, reflection index of the blackened silver image portion and haze of the non-image areas.

A further method for reducing the surface reflection index is described in JP-A-61-201235. Although the reflection index of the blackened silver image portion is thereby reduced, at least one additional layer of spherical grains or potato-shaped grains or silver halide grains having a diameter less than 5 times as great as the grain thickness, and which are less efficient in their use of silver than tabular silver halide grains, must be placed outside the emulsion layer comprising the tabular silver halide grains. As a result, more silver must be applied per unit area of the film to achieve the same maximum density ($D_{max}$) as compared to film comprising only tabular silver halide grains, this increasing the manufacturing cost thereof.

SUMMARY OF THE INVENTION

The present invention provides a photosensitive material having a reduced reflection index of the blackened silver image portion thereof after processing, and which contains tabular silver halide grains having an aspect ratio of 3 or more, this forming images which are easier to interpret.

The above object of the present invention has been achieved by a silver halide photographic material for X-ray use comprising a support having provided thereon at least one hydrophilic colloid layer, at least one of which must be a silver halide emulsion layer, wherein the silver halide emulsion layer contains tabular silver halide grains having an aspect ratio of 3 or more, and at least one of the silver halide emulsion layers or other hydrophilic colloid layers of the photographic material contains a polyhydroxy-substituted benzene compound in an amount of from $3\times10^{-2}$ to less than $5\times10^{-1}$ mol of silver.

DETAILED DESCRIPTION OF THE INVENTION

The technology for the addition of polyhydroxy-benzenes to light-sensitive material is well known and has been disclosed in JP-A-54-40629, JP-A-56-1936 and JP-A-62-21143. However, the above disclosures only apply to systems employing cubic grains of silver iodobromide.

The present inventors have discovered that the rise in the reflection index of the blackened silver image portion after processing, in a photosensitive material comprising tabular silver halide grains having an aspect ratio of at least 3 is reduced by the addition to the photosensitive material of polyhydroxy-substituted benzenes.

The following are typical examples of the polyhydroxy-substituted benzenes for use in the present invention:

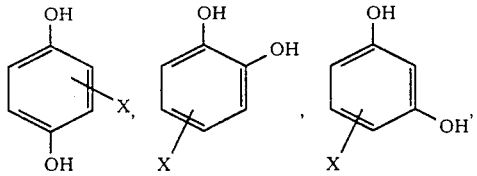

(Wherein X represents a substituent, and preferred substituents for X include:

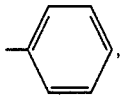

Of these substituents, —$SO_3K$, —COOH and —H are particularly preferred.)

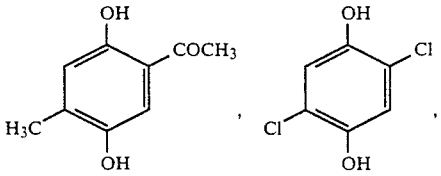

-continued

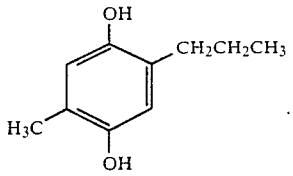

The compounds of this invention are not limited to the above.

Of these compounds, 1,4-dihydroxy-benzene derivatives such as

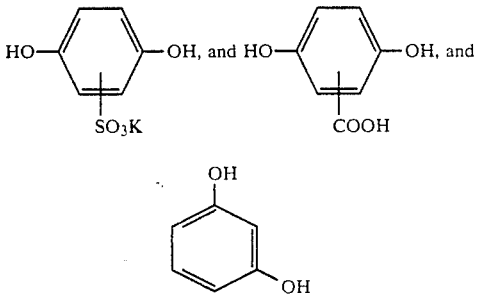

are preferred.

The polyhydroxy-substituted benzene compounds of the present invention may be added to the silver halide emulsion layer or to other hydrophilic colloid layers, but addition to the surface protecting layer and/or the silver halide emulsion layer is preferred.

The amount of the polyhydroxy-substituted benzene compound to be added is from $3\times10^{-2}$ mol to less than $5\times10^{-1}$ mol per mol of silver in the light-sensitive material. At an amount of less than $3\times10^{-2}$ mol per mol of silver, the surface gloss of the blackened silver image portion is inadequately reduced. At $5\times10^{-1}$ mol per mol of silver and above, the incremental reduction in gloss declines, and little additional effect is achieved by adding more of the polyhydroxy-substituted benzene compound.

Preferred addition amounts of the polyhydroxy-substituted benzene compound are from $3\times10^{-2}$ to $3\times10^{-1}$ mol and particularly from $5\times10^{-2}$ to $1\times10^{-1}$ mol per mol of silver.

The tabular silver halide grain-containing emulsion of the present invention is preferably spectrally sensitized by a sensitizing dye to blue, green, red or infrared light of relatively long wavelength.

Sensitizing dyes for use in the present invention include cyanine dyes, merocyanine dyes, complex cyanine dyes, complex merocyanine dyes, holopolar dyes, styryl dyes, hemicyanine dyes, oxonol dyes, hemioxonol dyes, etc.

Sensitizing dyes for use in the present invention are described, for example in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632, and 2,503,776 and JP-A-48-76525, and Belgian Patent No. 691,807, etc.

The sensitizing dyes for use in the present invention can be added at any stage in the process of manufacturing the photographic emulsion and can also be added at any stage after manufacture prior to coating. For example, the sensitizing dyes can be added during formation of the silver halide grains, the stage of physical ripening, the stage of chemical ripening, etc.

The tabular silver halide grain-containing emulsions for use in the present invention comprise silver chloride, silver chlorobromide, silver bromide, silver iodobromide and silver chloroiodobromide. For high sensitivity applications, silver bromide or silver iodobromide are preferred, especially with an iodide content of not more than 3.5 mol %.

The grain diameter of the projected surface area with regard to the tabular grain-containing emulsion of the present invention is preferably from 0.3 to 2.0 μm, and particularly preferably from 0.5 to 1.2 μm. The distance between parallel planes (thickness of grains) is preferably from 0.05 μm to 0.3 μm, and particularly preferably 0.1 to 0.25 μm. The preferred aspect ratio (grain diameter/thickness ratio) is 3 or more, preferably 3 or more but less than 20, and from 5 to less than 8 is particularly preferred.

The proportion of tabular grains having an aspect ratio of 3 or more in the emulsion layer of the present invention is 50% or more of the total silver halide grain area, preferably 70% or more and most preferably 90% or more.

The tabular silver halide grains of the present invention can be prepared by a suitable combination of methods known in the industry.

Tabular silver halide emulsions are described in *Evolution of the Morphology of Silver Bromide Crystals During Physical Ripening*, by Cugnac & Chateau (Scientific & Industrial Photography 33, 2, 1962, pp. 121–125), *Photographic Emulsion Chemistry*, by Duffin, Focal Press, New York, 1966, pp. 66–72 and by A. P. H. Trivelli & W. F. Smith in Photographic Journal, 80, p. 285 (1940) etc., and are readily prepared by reference to JP-A-58-127921, JP-A-58-113927 and JP-A-58-113928, and U.S. Pat. No. 4,439,520, etc.

Furthermore, the tabular grains of the present invention can be prepared by forming seed crystals wherein tabular grains are present in over 40% by weight in an environment with a relatively low pBr value of 1.3 or less, and then simultaneously adding silver and halide solute solutions while maintaining the same pBr value during seed crystal growth.

During the process of grain growth, it is preferable to add the silver and halide solute solutions in such a way as to prevent the growth of new crystal nuclei.

The size of the tabular silver halide grains is regulated by adjustment of the temperature, the type and amount of solvent, the control of the silver salts used during grain growth, and the rate of addition of halides, etc.

Among tabular silver halide grains, monodisperse hexagonal tabular grains are particularly useful.

Details of the structure and method of manufacture of monodisperse hexagonal tabular grains for use in the present invention is described in JP-A-63-151618 and summarized briefly as follows. The subject emulsion is a silver halide emulsion comprising a dispersion medium and silver halide grains. At least 70% of the total projected surface area of the silver halide grains has a hexagonal shape wherein the ratio of the length of the longest side to the length of the shortest side is 2 or less. The emulsion further comprises tabular silver halide grains having two parallel outer faces surfaces. In addition, the coefficient of variation of the grain size distribution of the hexagonal tabular silver halide grains (the value of the standard deviation of grain size, expressed as the circle-equivalent diameter of the projected surface area, divided by the average grain size) has a monodisperse characteristic of 20% or less.

Although the crystalline structure may be uniform, the interior and exterior preferably comprises different halide compositions and the structure may also be formed in layers. The grains should preferably contain a reduction sensitization silver nucleus.

Halide conversion type grains, described in GB Patent No. 635,841 and U.S. Pat. No. 3,622,318, are advantageously employed in the present invention. In relation to the amount of silver, the halide-converted amount is preferably from 0.2 mol % to 2 mol %, and particularly from 0.2 mol % to 0.6 mol %.

Silver iodobromide grains for use in the present invention having a structure with a higher iodide layer inside and/or on the surface of the grains is particularly preferred. The grains having a high iodide content layer therein are described in JP-A-59-99433.

By converting the surface of the tabular silver halide grains of the present invention, a higher sensitivity silver halide emulsion is obtained.

The method of halide conversion typically comprises addition of a halide aqueous solution having a lower solubility product with silver than the halide composition of the grain surface before halide conversion. For example, conversion occurs if aqueous solutions of potassium bromide and/or potassium iodide are added to tabular grains of silver chloride or silver chlorobromide. Additionally, conversion occurs if aqueous solutions of potassium iodide are added to tabular grains of silver bromide or silver iodobromide. Dilute aqueous solutions of the added halide solution are preferably employed. The concentration thereof should be not more than 30%, and preferably not more than 10%. It is preferable to add the conversion halide solution at a rate of not more than 1 mol % per minute per mole of the silver halide prior to conversion. In addition, during halide conversion, sensitizing dyes may be added and, instead of conversion halide aqueous solutions, fine grains of silver bromide, silver iodobromide or silver iodide may be added. The size of these fine grains should be not more than 0.2 μm, preferably not more than 0.1 μm, and most preferably not more than 0.05 μm. The preferred amount of halide conversion is from 0.1 to 1 mol % of the silver halide before conversion, and from 0.2 to 0.6 mol % is particularly preferred.

The method of halide conversion for use in preparing the silver halide emulsion of the present invention is not limited to any of the above methods, but and these methods may be used in combination. The silver halide composition of the grain surface prior to halide conversion should preferably be not more than 1 mol % of iodide, and not more than 0.3 mol % being particularly preferred.

During halide conversion of the silver halide emulsion of the present invention, a method wherein a silver halide solvent is present is particularly effective. Preferred solvents include thioether compounds, thiocyanates and 4-substituted thiourea. Of these, thioether compounds and thiocyanates are particularly effective. The use of 0.5 g to 5 g of thiocyanate per mole of silver halide and 0.2 to 3 g of thioether per mole of silver halide is preferred.

Further, as described in JP-A-61-230135 and JP-A-63-25653, the concurrent use of a compound which releases an inhibitor during development may also be incorporated into the photographic material of the present invention.

During silver halide grain formation or physical ripening of the silver halide emulsion of the present invention, cadmium salts, zinc salts, lead salts, thallium salts, iridium salts or complexes thereof, rhodium salts or complexes thereof, iron salts, complex iron salts, etc. may also be present.

During grain formation, silver halide solvents such as thiocyanates, thioether compounds, thiazolidine ethione and 4-substituted thiourea may also be added. Of these, thiocyanates, 4-substituted thiourea and thioethers are preferred solvents for use in the present invention.

Chemical sensitization methods for use in preparing the silver halide emulsion of the present invention include well-known methods such as the sulfur sensitization, selenium sensitization, reduction sensitization, gold sensitization, etc., either singly or in combination thereof.

Since the method of gold sensitization is typical of sensitization methods with noble metals, it is mainly gold complex salts which are used. There is no objection to the inclusion of complex salts of Noble metal complex salts other than gold, e.g. platinum, palladium, iridium, etc., may be employed for chemical sensitization. Specific examples thereof are described in U.S. Pat. No. 2,448,060, GB Patent 618,061, etc.

Sulfur sensitizers for use in preparing the silver halide emulsion of the present invention include, as well as the sulfur compounds contained in gelatin, other sulfur compounds such as thiosulfates, thioureas, thiazoles, rhodanines, etc.

The combined use of sulfur sensitization by a thiosulfate and gold sensitization enhances the effect of the present invention.

Reducing sensitizers for use in the present invention include stannous salts, amines, formamidinesulfinic acid, silane compounds, etc.

The peak development initiator type grains described in JP-A-63-305343 are advantageously employed as the tabular grains of the present invention.

To prevent fogging during -the manufacturing process of the photosensitive material of the present invention, during storage or during photographic processing, or to improve the photographic performance, various compounds can be incorporated into the photographic emulsions of the present invention apart from the silver halide absorbers during chemical sensitization. Well-known examples of antifogging agents or stabilizers include azoles (e.g. benzothiazolium salts, nitroimidazoles, nitrobenzimidazoles, chlorobenzimidazoles, bromobenzimidazoles, nitroindazoles, benzotriazoles, aminotriazoles etc.); mercapto compounds (e.g. mercaptothiazoles, mercapto benzothiazoles, mercaptobenzimidazoles, mercaptothiadiazoles, mercaptotetrazoles, mercaptopyrimidines, mercaptotriazines etc.); thioketones such as oxazolinethione; azaindenes (e.g. triazaindenes, tetraazaindenes, [especially 4-hydroxy-substituted (1,3,3a,7)tetraazaindenes], pentaazaindenes etc.); benzenethiosulfonic acid, benzenesulfinic acid, benzenesulfonic acid amide etc., may be added.

Especially preferred for use in the present invention are the nitron and nitron derivatives described in JP-A-60-76743 and JP-A-60-87322, the mercapto compounds described in JP-A-60-80839 and the heterocyclic compounds and complex, salts of silver and heterocyclic compounds (e.g., silver 1-phenyl-5-mercaptotetrazole) described in JP-A-57-164735.

The photographic emulsion layer or other hydrophilic colloid layers of the present invention may also contain various surfactants for such purposes as coating aids, static prevention, slip improvement, emulsification and dispersion, prevention of adhesion and improvement of the photographic characteristics (e.g., development, acceleration, film hardening, sensitization, etc.)

Examples are of the above surfactants include saponins (steroid based), alkylene oxide derivatives (for example, polyethylene glycol, polyethylene glycol/-polypropylene glycol condensate, polyethylene glycol alkyl ethers or polyethylene glycol alkyl aryl ethers, polyethylene oxide addition products of silicone), sugar alkyl esters and other non-ionic surfactants;

alkyl sulfonates, alkylbenzene sulfonates, alkylnaphthalene sulfonates, alkylsulfuric acid esters,, N-acyl-N-alkyltaurines, sulfosuccinic acid esters, sulfoalkylpolyoxyethylene alkylphenyl ethers and other anionic surfactants;

alkylbetaines, alkylsulfobetaines and other amphoteric surfactants; and aliphatic or aromatic quaternary ammonium salts, pyridinium salts, imidazolium salts and other cationic surfactants.

Among these, the anions of, for example, saponins, sodium dodecylbenzenesulfonate, sodium di-2-ethylhexyl-$\alpha$-sulfosuccinate, sodium p-octylphenoxyethoxyethane sulfonate, sodium dodecylsulfate, sodium triisopropylnaphthalene-sulfonate and sodium N-methyloleoyl taurate, the cations of, for example, dodecyltrimethylammonium chloride, N-oleoyl-N',N',N'-trimethylammoniodiaminopropane bromide and dodecylpyridium chloride, betaines such as N-dodecyl-N, N-dimethylcarboxybetaine and N-oleyl-N,N-dimethyl-sulfobutylbetaine, and non-ionic surfactants such as poly-(average degree of polymerization n=10) oxyethylene-cetyl ether, poly(n=25) oxyethylene-p-nonylphenol ether, bis (1-poly(n=15) oxyethyleneoxy-2,4-di-t-pentylphenyl)ethane is particularly preferred.

As antistatic agents for use in the present invention, potassium perfluorooctane sulfonate, sodium N-propyl-N-perfluorooctanesulfonylglycine, sodium N-propyl-N-perfluorooctanesulfonylaminoethyloxypoly(n=3) oxyethylenebutane sulfonate, N-perfluorooctanesulfonyl-N', N',N'-trimethylammoniodiaminopropane chloride, N-perfluorodecanoylamiinopropyl-N', N'-dimethyl-N'-carboxybetaine and other fluorine-containing surfactants, also non-ionic surfactants as described in JP-A-60-80848 and JP-A-61-112144, JP-A-62-172343 and JP-A-62-173459, etc., nitrates of alkali metals, conductive tin oxide, zinc oxide, vanadium pentaoxide or complex oxides of these doped with antimony or the like is preferred.

Matting agents for use in the present invention include those described in U.S. Pat. Nos. 2,992,101, 2,701,245, 4,142,894 and 4,396,706 comprising homopolymers of polymethyl methacrylate, copolymers of methyl methacrylate and methacrylic acid, starch or other organic compounds and fine grains of inorganic compounds such as silica, titanium dioxide, sulfuric acid, strontium, barium, etc.

The grain size of the above matting agents is preferably from 1.0 to 10 $\mu$m, and particularly 2 to 5 $\mu$m.

Lubricants for use in the surface layer of the photosensitive material of the present invention include silicones as described in U.S. Pat. Nos. 3,489,576 and 4,047,958 and colloidal silica as described in JP-B-56-23139 (the term "JP-B" as used herein means an "examined Japanese patent publication"), also paraffin wax, higher aliphatic acid esters, starch derivatives, etc.

In the hydrophilic colloid layers of the photosensitive material of the present invention, polyols such as trimethylolpropane, pentanediol, butanediol, ethylene glycol, glycerin, etc., may be used as plasticizers.

As a binder or protective colloid for the emulsion layers, intermediate layers and surface protection layers of the photosensitive material of the present invention, gelatin is useful, but other hydrophilic colloids may also be used.

Many synthetic hydrophilic high polymers may be employed in the material of the present invention such as gelatin derivatives, graft polymers of gelatin and other high polymers, proteins such as albumin and casein; cellulose derivatives such as hydroxyethyl cellulose, carboxymethyl collulose, cellulose sulfate esters, sugar derivatives such as sodium alginate, dextran, starch derivatives, etc.; polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., either singly or in combination thereof.

Gelatin for use in the present invention includes lime-treated gelatin, acid-treated gelatin and enzyme-treated gelatin in addition to the hydrolyzate and enzymatic degradation products of gelatin.

The use of polyacrylamide and dextran having an average molecular weight of not more than 50,000 together with gelatin is preferred. The method described in JP-A-63-68837 and JP-A-63-149641 are also advantageously used in the present invention.

The photographic emulsion layer and light-insensitive hydrophilic colloid layer of the present invention may contain inorganic or organic film hardening agents. Preferred examples include chromium salts (chrome alum etc.), aldehydes (formaldehyde, glutaraldehyde etc.), N-methylol compounds (e.g., dimethylol urea etc.), dioxane derivatives (2,3-dihydroxydioxane etc.), active vinyl compounds (such as 1,3,5-triacryloylhexahydro-s-triazine, bis(vinylsulfonyl) methyl ether, N,N'-methylenebis[β-(vinylsulfonyl) propionamide] etc.), active halides (such as 2,4-dichloro-6-hydroxy-s-triazine), mucohalogenic acids (mucochloric acid etc.), isooxazoles, dialdehyde starch, 2-chloro-6-hydroxytriazinyl gelatin etc., either singly or in combination. Preferred compounds among these are the active vinyl compounds described in JP-A-53-41221, JP-A-53-57257, JP-A-59-162546 and JP-A-60-80846 and the active halides described in U.S. Pat. No. 3,325,287.

Further useful compounds for use in the present invention include N-carbamoylpyridinium salts (e.g., (1-morpholinocarbonyl-3-pyridinio)methane sulfonate, etc.), and haloamidinium salts (e.g., 1-(1-chloro-1-pyridinomethylene)pyrrolidinium-2-naphthalene sulfonate, etc.).

High polymer film hardening agents are also advantageously employed in the present invention.

Examples of high polymers for use as hardening agents in the present invention include dialdehyde starch, polyacrolein, polymers with an aldehyde group such as the acrolein copolymer described in U.S. Pat. No. 3,396,029, polymers having an epoxy group as described in U.S. Pat. No. 3,623,878, polymers having a dichlorotriazine group as described in U.S. Pat. No. 3,362,827 and *Research Disclosure*, No. 17333 (September, 1978), polymers having active ester groups as described in JP-A-56-66841 and polymers having active vinyl groups or precursors thereof as described in JP-A-56-142524, U.S. Pat. No. 4,161,407, JP-A-54-65033 and *Research Disclosure*, No. 16725 (March, 1978). Preferred polymers are those having active vinyl groups or precursors thereof, and of these, polymers wherein the active vinyl group or the precursor thereof is linked to the main chain by a long spacer, as described in JP-A-56-142524, are particularly preferred.

Preferred . supports for use in the present invention include polyethylene terephthalate film or cellulose triacetate film.

In order to improve the adhesive force of the support of the present invention to the hydrophilic colloid layer, preferred methods of treatment thereof include corona discharge of the surface, glow discharge or infrared irradiation treatment. Alternatively, an undercoating of a styrene-butadiene based latex or a vinylidene chloride-based latex may be applied. An additional layer of gelatin may also be applied as the top layer. Moreover, an undercoating of an organic solvent containing a polyethylene swelling agent and gelatin may also be employed. By the application of a surface treatment to these underlayers, the adhesive force of the hydrophilic colloid layer is enhanced.

In order to absorb light of a specific wavelength, (i.e., halation and irradiation with the provision of a filter layer to control the spectral composition of the light being irradiated onto the photographic emulsion layer of the silver halide photographic materials of the present invention), the silver halide photographic emulsion layer or other layer of the present invention may be colored with dyes. In double-sided film such as direct medical X-ray film, a filter layer provided to eliminate cross-over may be placed beneath the emulsion layer. Dyes of this type for use in the present invention include oxonol dyes containing pyrazolone nuclei and barbituric acid nuclei, azo dyes, azomethine dyes, anthraquinone dyes, arylidene dyes, styryl dyes, triarylmethane dyes, merocyanine dyes, cyanine dyes, etc. The preferred amount of dye used is from 0.5 to 200 $mg/m^2$ and from 2 to 50 $mg/m^2$ being particularly preferred.

Typical dyes are shown below, but the invention is not limited thereby.

1
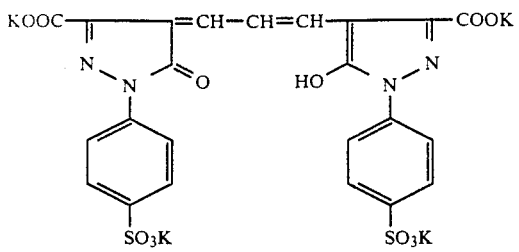
2
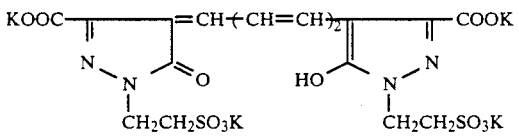
3
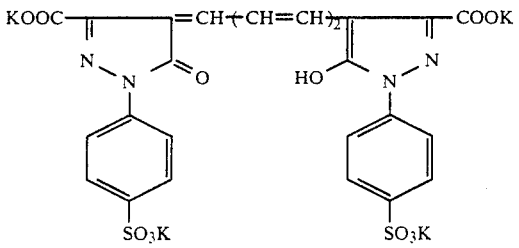
4
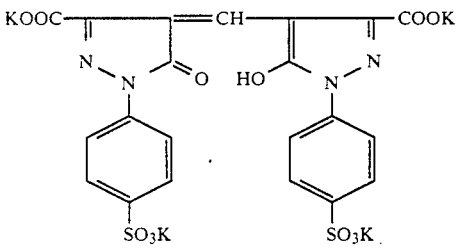
5
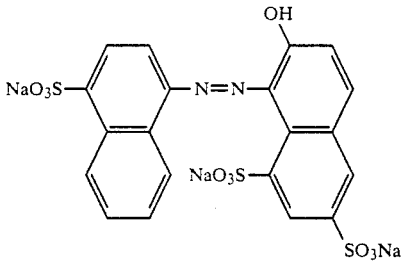
6
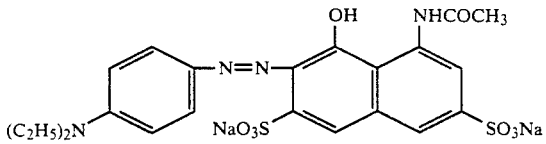
7
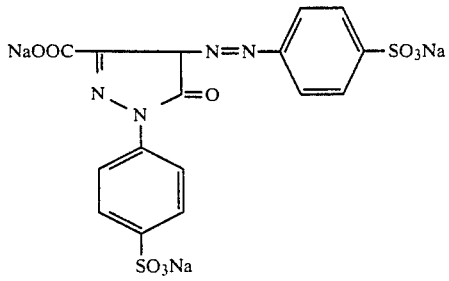

-continued
8
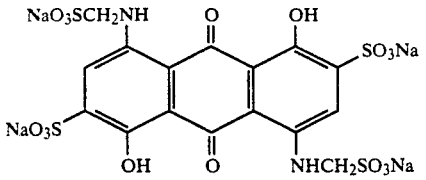
9
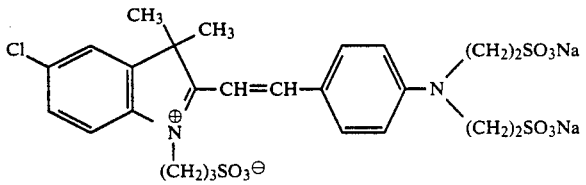
10
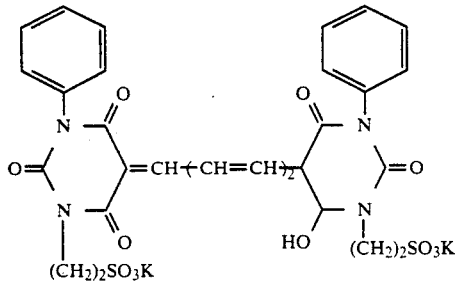
11
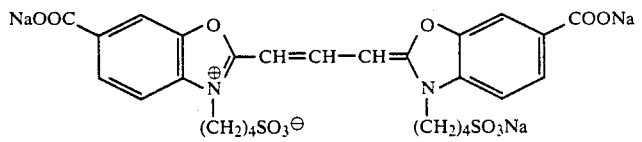
12
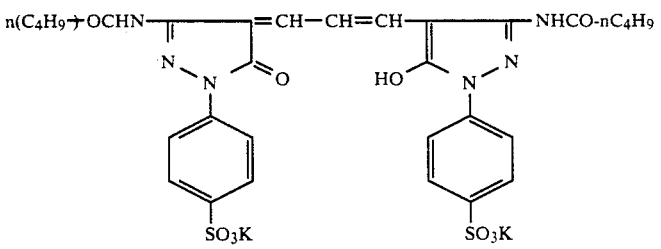
13
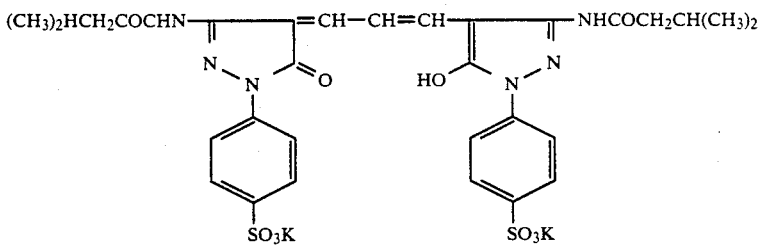
14
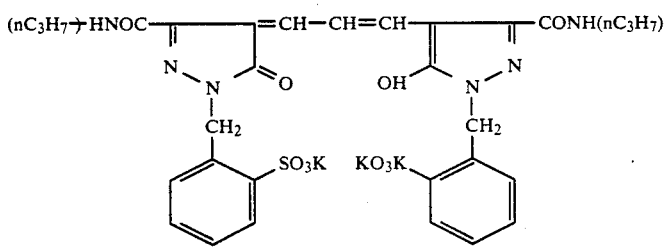

-continued

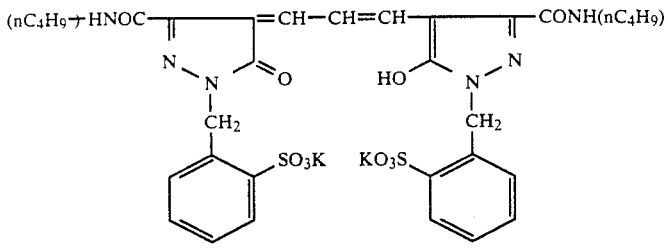

The avove-noted filter dyes may be advantageously employed by mordanting a specific layer of the light-sensitive material of the present invention using a polymer having cationic sites and an anionic dye. In this regard, it is preferable to use a dye which irreversibly loses its color in the process of development-fixing-washing. Mordanting of the dyes using a polymer having cationic sites may occur either in the emulsion layer, the surface protective layer or on the side opposite to the emulsion layer and support, but mordanting of the dyes between the emulsion layer and the support is preferred. Mordanting of the undercoating layer is ideal to eliminate cross-over on two-sided medical X-ray film.

As an auxiliary coating agent for the bottom layer, a polyethylene oxide-based non-ionic surfactant is preferred in combination with the polymer having cationic sites.

An anion exchange polymer is preferred as the polymer providing the cationic sites.

Various well-known quaternary ammonium salt (or phosphonium salt) polymers can be used as the above-noted anion exchange polymer. Quaternary ammonium salt (or phosphonium salt) polymers for use in the present invention a mordanting polymers and static-preventing polymers are described in JP-A-59-166940, U.S. Pat. No. 3,958,995, JP-A-55-142339, JP-A-54-126027, JP-A-54-155835, JP-A-53-30328 and JP-A-54-92274, which describe water dispersed latexes; U.S. Pat. Nos. 2,548,564, 3,148,061 and 3,756,814, which describe polyvinyl pyridinium salts; U.S. Pat. No. 3,709,690 which describes water soluble quaternary ammonium salt polymers; U.S. Pat. No. 3,898,088 which describes water insoluble quaternary ammonium salt polymers, etc.

Furthermore, it is particularly preferable to copolymerize monomers having 2 or more (preferably 2 to 4) unsaturated ethylenic groups and to use these as cross-linked aqueous polymer latexes. Such polymers do not impair photographic performance by transfering from the desired layer into another layer or into the processing solution.

The following are specific examples of such cross-linked polymer latexes for use as the mordanting agent of the present invention.

(1)

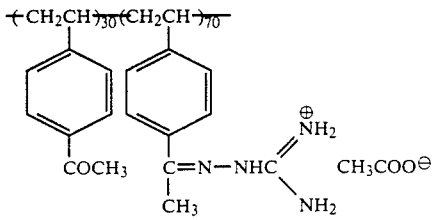

-continued (2)

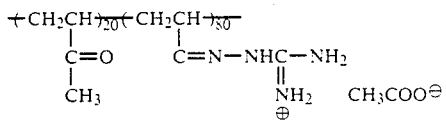

(3)

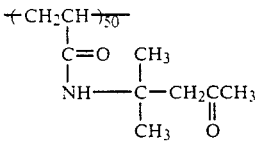

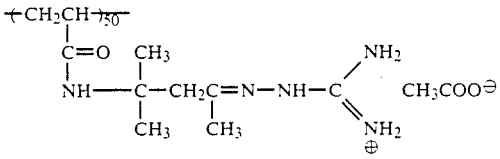

(4)

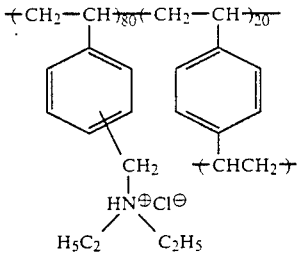

(5)

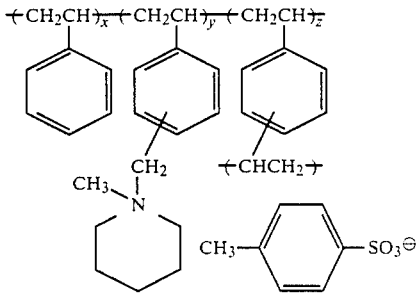

x:y:z = 47.5:47.5:5 (by mol)

-continued (6)

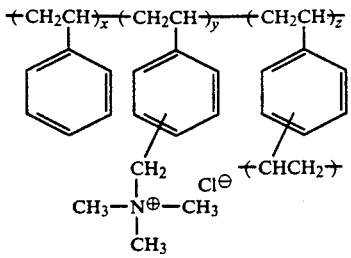

x:y:z = 45:45:10 (by mol)

In order to improve the pressure characteristics of the emulsion layer of the photographic material of the present invention, plasticizers such as polymers and emulsifiers may be added.

No special restriction need be applied to the remaining composition of the emulsion layer of the silver halide photographic material of the present invention, and various additives may be additionally incorporated. Examples thereof are the binders, surfactants, dyes, ultraviolet absorbers, film hardening agents, auxiliary coating agents, thickening agents, etc. described in *Research Disclosure*, Vol. 176, pp. 22 to 28 (December, 1978).

With regard to the photographic processing of the photographic material of the present invention, well-known methods and processing solutions can be used, as described in *Research Disclosure*, Vol. 176, pp. 28 to 30 (RD-17643). The processing temperature is usually set to be between 18° C. and 50° C., but the range from 25 to 38° C. is preferable.

The developing solutions for use in processing the photographic material of the present invention may contain well-known developing agents. Developing agents for use singly, or in combination thereof are the dihydroxybenzenes (e.g. hydroquinone), 3-pyrazolidones (e.g. 1-phenyl-3-pyrazolidone), aminophenols (e.g. N-methyl-p-aminophenol), etc. The developing solutions may also contain well-known preservatives, alkalies, pH buffers, antifogging agents, etc. Where necessary, auxiliary solvents, color toners, surfactants, defoaming agents, water softeners, film hardening agents (e,g, glutaraldehyde), viscosity-imparting agents, etc. may also be added.

Fixing solutions of conventional composition may be used in processing the photographic material of the present invention. Not only may thiosulfates and thiocyanates be used as fixing agents but organic sulfur compounds known to have a fixing effect may also be employed. The fixing solution may also contain water soluble aluminium salts as film hardening agents.

The invention is now explained in detail by the following non-limiting examples. Unless otherwise indicated, all parts, percents and ratios are by weight.

EXAMPLE 1

The surface of polyethylene terephthalate film support, 175 μm thick, biaxially stretched and blue-dyed, was subjected to corona discharge treatment. A first undercoating solution of the composition below was applied with a wire bar coater in an amount of 5.1 cc/m² and dried for 1 minute at 175° C. A first undercoating layer was then similarly applied to the opposite side of the support.

| | |
|---|---|
| Butadiene-styrene copolymer latex solution (solids 40%, weight ratio of butadiene/styrene 31/69) | 79 cc |
| 2,4-Dichloro-6-hydroxy-s-triazine sodium salt, 4% solution | 20.5 cc |
| Distilled water | 900.5 cc |
| $n\text{-}C_6H_{13}OOCCH_2$ / $n\text{-}C_6H_{13}OOCCH{-}SO_3Na$ | |

was also added in an amount of 0.4 wt % in relation to the latex solids to the latex solution as an emulsifying and dispersing agent.

The following two solutions (a) and (b) were prepared. After homogenization, the solutions (a) and (b) were mixed to provide a second undercoating solution:

| | |
|---|---|
| Solution (a): | |
| Gelatin | 8 g |
| Polymer latex with a solids content of 15% | 31 cc |

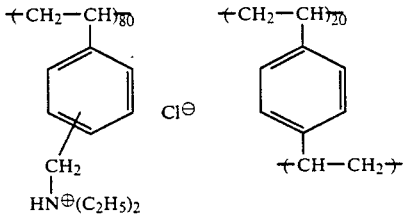

| | |
|---|---|
| Dye compound example 15 as a 3% aqueous solution | 63 cc |

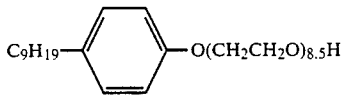

| | |
|---|---|
| as a 1% water/methanol (1:1) solution | 20 cc |
| Methyl cellulose (Shin-Etsu Chemical Co., Ltd.: "Metrose" SM 15) | 0.2 g |
| $H_2O$ | 567 cc |
| Solution (b): | |
| Gelatin | 2 g |
| Matting agent: polymethyl methacrylate of average particle size 2.5 μm | 0.3 g |

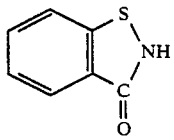

| | |
|---|---|
| as a 3.5% methanol solution | 1 cc |
| $H_2O$ | 308 cc |

The undercoated film support was prepared by applying 8.5 cc/m² of a mixed solution of (a) and (b), one side at a time, to both sides of the support having provided thereon a first undercoating on both sides as described above, followed by drying.

PREPARATION OF THE EMULSION LAYER COATING SOLUTIONS

Preparation of Emulsion A 5 g of potassium bromide, 0.05 g of potassium iodide, 30 g of gelatin and 2.5 cc of a 5 aqueous solution of thioether were added to one liter of water. While maintaining the solution at 75° C. with stirring, an aqueous solution containing 8.33 g of silver nitrate and an aqueous solution containing 5.94 g of potassium bromide and 0.726 g of potassium iodide were added over a period of 45 seconds by the double jet method. Then, after adding 2.5 g of potassium bromide, an aqueous solution containing 8.33 g of silver nitrate was added for 7 minutes 30 seconds such that the flow rate at the end of the addition was twice that at the start of addition. An aqueous solution of 153.34 g silver nitrate and an aqueous solution of potassium bromide were next added for 25 minutes by the control double jet method while retaining the potential at pAg 8.1. The flow rate at this time was accelerated so that the flow rate at the end of addition was 8 times the starting flow rate. When addition was complete, 15 cc of 2N potassium thiocyanate and 50 cc of a 1% potassium iodide aqueous solution were added over a period of 30 seconds. The temperature was then reduced to 35° C., and the soluble salts were removed by the precipitation method. The temperature was then raised to 40° C., and 68 g of gelatin, 2 g of phenol and 7.5 g of trimethylolpropane were added. The pH was controlled to 6.40 and the pAg to 8.45 using caustic soda and potassium bromide.

After further raising the temperature to 56° C., 735 mg of a sensitizing dye of the composition below was added. After ten minutes, 8.2 mg of sodium thiosulfate, 163 mg potassium thiocyanate pentahydrate and 5.4 mg of chloroauric acid were added and after 5 minutes, the emulsion was rapidly cooled and allowed to solidify. 93% of the total projected surface area of all grains in the emulsion thus obtained had grains having an aspect ratio of at lest 3. The average projected surface area diameter of all grains having an aspect ratio of 2 or more was 0.83 μm. The coefficient of variation was 18.5%. The average grain thickness was 0.161 μm, and the average aspect ratio was 5.16.

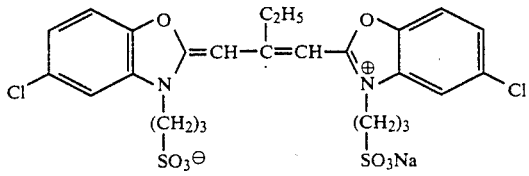

A coating solution was prepared by adding the following chemicals per mole of silver halide in the emulsion:

| | |
|---|---|
| 4-Hydroxy-6-methyl-1,3,3a,7-tetraazaindene | 1.94 g |
| 2,6-Bis(hydroxyamino)-4 diethylamino-1,3,5-triazine | 80 mg |
| Sodium polyacrylate (average molecular weight 41,000) | 4.0 g |
| Polyhydroxybenzene | amount added as shown in Table 1 |
| Copolymer plasticizer with component ratio of 95/5 ethyl acrylate/acrylic acid | 20.0 g |

The emulsion layer coating solution prepared in this manner was applied to both sides of the above support by simultaneous extrusion with the surface protection layer described below.

The emulsion layer and surface protection layer were applied, per silver, in the following amounts:

| | |
|---|---|
| Emulsion Layer | |
| Amount of silver coating | 1.9 g/m² |
| Amount of gelatin coating | 1.5 g/m² |
| Surface Protection Layer | |
| Gelatin | 0.81 g/m² |
| Dextran (average molecular weight 39,000) | 0.81 g/m² |
| Matting agent (average particle size 3.5 μm) polymethyl methacrylate/methacrylic acid = 9:1 copolymer | 0.06 g/m² |
| $C_8H_{17}$—(C₆H₄)—$O(CH_2CH_2O)_{10}(CH_2CH(OH)CH_2O)_3H$ | 60 mg/m² |
| $C_8H_{17}$—(C₆H₄)—$O(CH_2CH_2O)_2CH_2CH_2SO_3Na$ | 20 mg/m² |
| $C_8F_{17}SO_2N(C_3H_7)(CH_2CH_2O)_4(CH_2)_4SO_3Na$ | 2 mg/m² |
| $C_8F_{17}SO_2N(C_3H_7)(CH_2CH_2O)_{15}H$ | 5 mg/m² |
| Sodium polyacrylate (average molecular weight 41,000) | 70 mg/m² |

A film hardening agent, 1,2-bis(sulfonylacetamide)ethane, was applied in an amount of 69 mg/m² per side. The type and amount added of hydroxy-substituted benzene were varied to obtain photographic materials 1 to 15 as indicated in Table 1 below.

A GRENEX series G-4 screen made by Fuji Photo Film Co., Ltd. ($Gd_2O_2S$:Tb) was used to expose the above prepared photographic materials. Following a conventional X-ray exposure and evaluation procedure, photographic materials 1 to 15 were tightly inserted between two G-4 screens and exposed to X-rays for 0.1 second through 10 cm of "water phantom".

The post-exposure development processing was carried out automatically for 90 seconds, with a FPM-4000 made by Fuji Photo Film Co., Ltd. using a RD-III developing solution also made by Fuji Photo Film Co., Ltd., at 35° C. and using Fuji F fixer.

The surface gloss and degree of haze were then evaluated as follows:

(1) Evaluation of surface gloss

The surface gloss was evaluated on the above prepared photographic materials which had been automatically developed as described above after having been exposed in an amount resulting in maximum density ($D_{max}$). Surface gloss was measured by the method described in JIS Z-8741, with an angle of incidence and angle of reflection both being 20°. The smaller the numerical value of the resulting measurment, the duller the photograph. In practice, it is desirable that the surface gloss of the exposed image portion be less than 10.

Table 1 shows the results along with the sample details.

TABLE 1

| Photographic material | Polyhydroxy-substituted benzene added and amount added (moles/mole of silver) | | Relative sensitivity | Surface gloss of exposed image portion | Degree of haze |
|---|---|---|---|---|---|
| 1 (comparison) | none | | 100 | 12 | 14 |
| 2 (comparison) | 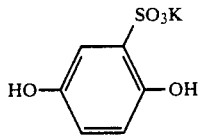 | $1 \times 10^{-2}$ | 104 | 11 | 13.5 |
| 3 (invention) | " | $5 \times 10^{-2}$ | 100 | 5.5 | 14 |
| 4 (invention) | " | $1 \times 10^{-1}$ | 98 | 4.5 | 15 |
| 5 (comparison) | 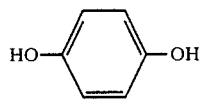 | $5 \times 10^{-3}$ | 102 | 11.5 | 13 |
| 6 (comparison) | " | $1 \times 10^{-2}$ | 98 | 11 | 13.5 |
| 7 (invention) | " | $5 \times 10^{-2}$ | 92 | 7.5 | 14 |
| 8 (invention) | " | $1 \times 10^{-1}$ | 79 | 6 | 14 |
| 9 (comparison) | 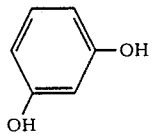 | $1 \times 10^{-2}$ | 102 | 11 | 13 |
| 10 (invention) | " | $5 \times 10^{-2}$ | 98 | 7 | 13.5 |
| 11 (invention) | " | $1 \times 10^{-1}$ | 92 | 6 | 13.5 |
| 12 (invention) | " | $2.5 \times 10^{-1}$ | 79 | 5 | 14 |
| 13 (comparison) | " | $5 \times 10^{-1}$ | 71 | 4.5 | 14 |
| 14 (invention) | 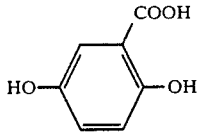 | $3 \times 10^{-2}$ | 102 | 8 | 14 |
| 15 (invention) | " | $5 \times 10^{-2}$ | 100 | 5 | 14 |

The relative sensitivity shows the values taking photographic sample 1 as 100 for a sensitivity of fogging + density 1.0

(2) Evaluation of degree of haze

Using a turbidimeter made by Nippon Denshoku Kogyo Ltd., unexposed photographic material was automatically processed as described above. The degree of haze of the samples thus processed was automatically measured using the turbidimeter according to the following equation:

$$\text{degree of haze} = \frac{\text{scattered light}}{\text{total light transmitted}} \times 100\ (\%)$$

The lower the degree of haze, the less the turbidity which is a desirable property of the photographic material.

It is clear from Table 1 that as a result of adding polyhydroxy-substituted benzene, the surface gloss of the exposed image portion was reduced without an increase in haze. However, when $5 \times 10^{-1}$ mol/mol Ag was added as in photographic material 13, there was less reduction in the surface gloss and the relative sensitivity declined. Conversely, when less than $3 \times 10^{-2}$ mol/mol Ag was present, there was little effect. Therefore the appropriate amount of polyhydroxy-substituted benzene to be added is from $3 \times 10^{-2}$ to $5 \times 10^{-1}$ mol/mol Ag.

EXAMPLE 2

When the polyhydroxy-substituted benzene added to the emulsion layer in Example 1 was instead added to the surface protection layer, results identical to that of Example 1 were obtained, showing the efficacy of the invention.

EXAMPLE 3

(1) Preparation of tabular silver halide emulsion 30 g gelatin and 6 g of potassium bromide were added to one liter of water. While stirring in a container kept at 60° C., an aqueous solution of potassium bromide containing an aqueous solution of silver nitrate (5 g as silver nitrate) and 0.15 g of potassium iodide was added for one minute by the double jet method. A further aqueous solution of potassium bromide containing an aqueous solution of silver nitrate (145 g as silver nitrate) and 4.2 g of potassium iodide was then added by the double jet method. The flow rate of this addition was arranged such that the flow rate at the end of addition was 5 times that at the start of addition. When the addition was complete, the soluble salts were removed by the precipitation method at a temperature of 35° C. The temperature was then raised to 40° C., and an additional 75 g of gelatin was added. The pH was adjusted to 6.7. The emulsion thus obtained were tabular grains having an average projected surface area diameter of 0.98 μm and an average thickness of 0.138 μm. The silver iodide content was 3 mol %. After chemical sensitization of this emulsion with gold and sulfur sensitizers, the polyhydroxy benzenes shown in Table 2 were added. A polyacrylamide of molecular weight (MW) 8,000 was also added to produce a coating solution containing tabular silver halide grains. The specific gravity of the coating solution was 1.140, the silver/gelatin weight ratio was 1.06 and the polyacrylamide/gelatin weight ratio was 0.2.

This coating solution was applied as in Example 1 to provide a silver coating on each side of the support in an amount of 2 g/m$^2$.

(2) Preparation of coating solution for light-insensitive hydrophilic colloid layer (surface protection layer)

A light-insensitive hydrophilic colloid layer with a gelatin concentration of 10 wt % was prepared by adding particles of polymethyl methacrylate (average particle size 3.6 μm) as a matting agent, saponin and the vinylsulfone-based film hardening agent V-28 described in JP-A-61-117534 to high polymer lime-treated gelatin for photographic applications (number-average molecular weight 70,000). The amount of polymethyl methacrylate particles added to one side of the support was 40 mg/m$^2$, the amount of saponin per side was 50 mg/m$^2$ and 2.0 wt % of the film hardening agent was added in relation to the total coated gelatin (total of emulsion layer gelatin+surface protection layer gelatin). The surface protection layer coating was applied to both sides of a 175 μm polyethylene terephthalate base at the same time as the above described emulsion coating solution such that the coating amount of gelatin in the light-insensitive layer was 1.2 g/m$^2$ per side.

Photographic materials 16 to 20 were obtained in this manner.

The surface gloss of the exposed and development processed image area of the photographic materials thus obtained was evaluated in addition to the film hardness.

Surface gloss was evaluted as in Example 1. The film hardness was evaluated as follows.

EVALUATION OF FILM HARDNESS

The hardness of the film was evaluated by impregnating the coating sample in RD-III developing solution at 35° C. for 25 seconds and then pressing a needle with a stainless steel ball of end diameter 0.5 mm against the film surface and continuously varying the weight on the needle while moving it at the rate of 5 cm/sec. The hardness of the film is determined by load in grams at the break part of the emulsion film (scratch damage).

In practice a figure of over 60 g is desirable.

Table 2 shows the results along with the sample details.

TABLE 2

| Photographic material | Polyhydroxy-substituted benzene added and amount added (moles/mole of silver) | | Surface gloss of exposed image portion | Film strength |
|---|---|---|---|---|
| 16 (comparison) | none | | 30 | 140 |
| 17 (invention) | 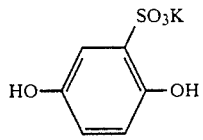 | $5 \times 10^{-2}$ | 9 | 131 |
| 18 (invention) | " | $1 \times 10^{-1}$ | 7.5 | 120 |
| 19 (invention) | 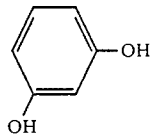 | $1 \times 10^{-1}$ | 9 | 140 |

TABLE 2-continued

| Photographic material | Polyhydroxy-substituted benzene added and amount added (moles/mole of silver) | | Surface gloss of exposed image portion | Film strength |
|---|---|---|---|---|
| 20 (invention) | 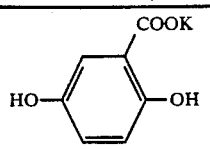 | $5 \times 10^{-2}$ | 8 | 91 |

It is clear from Table 2 that by adding a polyhydroxy-substituted benzene, the surface gloss reduced without undue loss of film strength. This clearly shows the practicality of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic material for X-ray use comprising a support having provided thereon at least one hydrophilic colloid layer, at least one of which is a silver halide emulsion layer, wherein said silver halide emulsion layer contains tabular silver halide grains having an aspect ratio of 3 or more, and at least one of said silver halide emulsion layers or other hydrophilic colloid layers of said photographic material contains a polyhydroxy-substituted benzene compound in an amount of from $3\times10^{-2}$ mol to less than $5\times10^{-1}$ mol per mole of silver.

2. A silver halide photographic material as in claim 1, wherein said polyhydroxy-substituted benzene compound is selected from the group consisting of

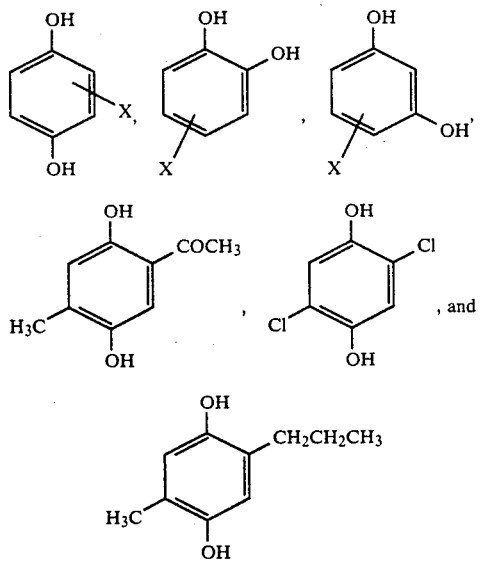

wherein X represents a substituent.

3. A silver halide photographic material as in claim 2, wherein the substituent represented by X is selected from the group consisting of:

—H, —OH,

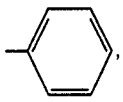

—Cl, —Br, —COOH, $—CH_2CH_2COOH$, $(CH_3)_2CH—$, $—CH_3$, $(CH_3)_3C—$, $—OCH_3$, —CHO, and $—SO_3K$.

4. A silver halide photographic material as in claim 2, wherein said polyhydroxy-substituted benzene compound is selected from 1,4-dihydroxy-benzene derivatives and 1,3-dihydroxy benzene.

5. A silver halide photographic material as in claim 1, wherein the amount of said polyhydroxy-substituted benzene compound is from $5\times10^{-2}$ mol to $1\times10^{-1}$ mol per mol of silver.

6. A silver halide photographic material as in claim 1, wherein said silver halide emulsion layer containing tabular silver halide grains having an aspect ratio of 3 or more comprises silver halide emulsion grains having 0.3 to 2.0 μm in diameter of the projected surface area and 0.05 to 0.3 μm in thickness.

7. A silver halide photographic material as in claim 1, wherein said silver halide emulsion layer containing tabular silver halide grains having an aspect ratio of 3 or more comprises silver halide emulsion grains having 0.5 to 1.2 μm in diameter of the projected surface area and 0.1 to 0.25 μm in thickness.

8. A silver halide photographic material as in claim 1, wherein the proportion of said tabular silver halide grains having an aspect ratio of 3 or more in said silver halide emulsion layer is 50% or more of the total silver halide grain area.

9. A silver halide photographic material as in claim 1, wherein the proportion of said tabular silver halide grains having an aspect ratio of 3 or more in said silver halide emulsion layer is 70% or more of the total silver halide grain area.

10. A silver halide photographic material as in claim 1, wherein the proportion of said tabular silver halide grains having an aspect ratio of 3 or more in said silver halide emulsion layer is 90% or more of the total silver halide grain area.

* * * * *